US011373563B2

(12) United States Patent
Cheng et al.

(10) Patent No.: US 11,373,563 B2
(45) Date of Patent: Jun. 28, 2022

(54) ANTI-NOISE SIGNAL MODULATION CIRCUIT, MODULATION METHOD, DISPLAY PANEL AND DISPLAY DEVICE

(71) Applicant: BOE TECHNOLOGY GROUP CO., LTD., Beijing (CN)

(72) Inventors: Chih Jen Cheng, Beijing (CN); Xiaoliang Ding, Beijing (CN); Pengpeng Wang, Beijing (CN); Wei Liu, Beijing (CN); Yanling Han, Beijing (CN); Xueyou Cao, Beijing (CN); Ping Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 871 days.

(21) Appl. No.: 16/084,703

(22) PCT Filed: Jan. 15, 2018

(86) PCT No.: PCT/CN2018/072567

§ 371 (c)(1),
(2) Date: Sep. 13, 2018

(87) PCT Pub. No.: WO2019/010937

PCT Pub. Date: Jan. 17, 2019

(65) Prior Publication Data

US 2021/0201717 A1 Jul. 1, 2021

(30) Foreign Application Priority Data

Jul. 10, 2017 (CN) ..... 201710556766.1

(51) Int. Cl.
*G09G 3/00* (2006.01)

(52) U.S. Cl.
CPC ..... *G09G 3/00* (2013.01); *G09G 2300/0426* (2013.01); *G09G 2310/08* (2013.01);
(Continued)

(58) Field of Classification Search
CPC ..... G09G 3/00; G09G 2330/04; G09G 2300/0426; G09G 2330/08; G09G 2310/08; G09G 2360/14
See application file for complete search history.

(56) References Cited

U.S. PATENT DOCUMENTS

2014/0022069 A1 1/2014 Lichtenegger
2015/0145801 A1* 5/2015 Angelini ..... G06F 3/0446 345/174
2015/0378511 A1 12/2015 Wu et al.

FOREIGN PATENT DOCUMENTS

CN 101197531 A 6/2008
CN 101841644 A 9/2010
(Continued)

OTHER PUBLICATIONS

International Search Report and Written Opinion dated Apr. 20, 2018 from State Intellectual Property Office of the P.R. China.

*Primary Examiner* — Mark W Regn
(74) *Attorney, Agent, or Firm* — Dilworth & Barrese, LLP.; Michael J. Musella, Esq.

(57) ABSTRACT

An anti-noise signal modulation circuit, a modulation method, a display panel and a display device are disclosed. The anti-noise signal modulation circuit includes a frequency-modulation control sub-circuit. An input end of the frequency modulation control sub-circuit is configured to receive an initial signal, and an output end of the frequency-modulation control sub-circuit is connected to a signal processing circuit that is preset; the frequency-modulation control sub-circuit is configured to frequency-modulate the initial signal by a switch signal that hops according to a preset period, and to output a modulation result to the signal processing circuit; and a frequency corresponding to the switch signal does not overlap with a noise frequency.

12 Claims, 4 Drawing Sheets

(52) U.S. Cl.
CPC ..... *G09G 2330/04* (2013.01); *G09G 2330/08* (2013.01); *G09G 2360/14* (2013.01)

(56) References Cited

FOREIGN PATENT DOCUMENTS

| | | | |
|---|---|---|---|
| CN | 104469084 | A | 3/2015 |
| CN | 104539257 | A | 4/2015 |
| CN | 105278776 | A | 1/2016 |
| CN | 107195263 | A | 9/2017 |

* cited by examiner

ANTI-NOISE SIGNAL MODULATION CIRCUIT, MODULATION METHOD, DISPLAY PANEL AND DISPLAY DEVICE

TECHNICAL FIELD

Embodiments of the present disclosure relate to an anti-noise signal modulation circuit, a modulation method, a display panel and a display device.

BACKGROUND

Signal detection is of great significance in many devices, and the signal detection not only enables users to know a true state of relevant information of a device in time, but also facilitates to perform further processing based on the relevant state. For example, in the related technology field of display, characteristics of a detection sensor that changes with an environment is usually utilized, the changes are converted into currents or voltages, and the currents or voltages are input to a signal processing circuit to perform related signal detection. However, based on different detection requirements, detection sensors integrated into a display may be disposed anywhere on the display; in a case that a detection sensor is far away from the signal processing circuit that processes a detection signal; signals detected by the detection sensor can be transmitted to the signal processing circuit through a wiring. Meanwhile, due to the presence of many noise signals in the device, in a process of transmitting the detection signal through the wiring, it is very likely that an unexpected and severe noise signal is generated to the detection signal due to the voltage coupling during display or touch. Generally, in signal processing, if a frequency of the noise falls within a frequency band of the detection signal, it is difficult to achieve a good filtering effect.

The inventors have found that interference caused by noise signals in a device or in an external environment to related signals obtained in an existing device is difficult to be effectively eliminated.

SUMMARY

An embodiment of the present disclosure provides an anti-noise signal modulation circuit, comprising a frequency-modulation control sub-circuit. An input end of the frequency-modulation control sub-circuit is configured to receive an initial signal, and an output end of the frequency-modulation control sub-circuit is connected to a signal processing circuit that is preset; the frequency-modulation control sub-circuit is configured to frequency-modulate the initial signal by a switch signal that hops according to a preset period, and to output a modulation result to the signal processing circuit; and a frequency corresponding to the switch signal does not overlap with a noise frequency.

For example, the frequency-modulation control sub-circuit comprises a gating loop controlled by a preset periodic signal, the gating loop is configured to input the initial signal to a non-inverting input end of the signal processing circuit during a first time period of the preset periodic signal, and to input the initial signal to an inverting input end of the signal processing circuit during a second time period of the preset periodic signal; a preset reference signal is connected to the inverting input end of the signal processing circuit during the first time period, and is connected to the non-inverting input end of the signal processing circuit during the second time period; and the preset reference signal is used as a reference basis for the initial signal in the signal processing circuit.

For example, the frequency-modulation control sub-circuit comprises a first thin film transistor, a second thin film transistor, a third thin film transistor, and a fourth thin film transistor. The initial signal is connected to a first electrode of the first thin film transistor and a first electrode of the second thin film transistor, and the preset reference signal is connected to a first electrode of the third thin film transistor and a first electrode of the fourth thin film transistor. A connection between thin film transistors and the signal processing circuit is realized in at least two connection modes, a first connection mode of which is that: a second electrode of the first thin film transistor and a second electrode of the third thin film transistor are both connected to the non-inverting input end of the signal processing circuit, and a second electrode of the second thin film transistor and a second electrode of the fourth thin film transistor are both connected to the inverting input end of the signal processing circuit. A second connection mode is that: the second electrode of the first thin film transistor and the second electrode of the third thin film transistor are both connected to the inverting input end of the signal processing circuit, and the second electrode of the second thin film transistor and the second electrode of the fourth thin film transistor are both connected to the non-inverting input end of the signal processing circuit. A gate electrode of the first thin film transistor and a gate electrode of the fourth thin film transistor both are connected to a first control signal, a gate electrode of the second thin film transistor and a gate electrode of the third film transistor both are connected to a second control signal, a modulation pulse signal output by the first control signal and a modulation pulse signal output by the second control signal have opposite potentials, and the switch signal comprises the first control signal and the second control signal.

For example, the first control signal and the second control signal are timing signals having opposite potentials and a period of T, where a signal frequency 1/T corresponding to the timing signals is different from the noise frequency.

For example, the frequency-modulation control sub-circuit adopts at least two groups of thin film transistors to form a mirror structure, and is configured to control both a high level and a low level in a control signal, so that the initial signal forms current flows in different directions based on the mirror structure and is input to the signal processing circuit; where the frequency-modulation control sub-circuit achieves to modulate a frequency of the initial signal by the current flows in different directions.

For example, the frequency-modulation control sub-circuit comprises a fifth thin film transistor, a sixth thin film transistor, a seventh thin film transistor, and an eighth thin film transistor. A first electrode of the fifth thin film transistor and a first electrode of the sixth thin film transistor both are connected to the initial signal, a second electrode of the fifth thin film transistor is connected to a first electrode of the seventh thin film transistor, a gate electrode of the seventh thin film transistor, and a gate electrode of the eighth thin film transistor, and a second electrode of the seventh thin film transistor is connected to the second electrode of the eighth thin film transistor. A first electrode of the eighth thin film transistor and a second electrode of the sixth thin film transistor both are connected to the non-inverting input end of the signal processing circuit, and the preset reference signal is correspondingly connected to the inverting input end of the signal processing circuit; alternatively, the first electrode of the eighth thin film transistor and the second electrode of the sixth thin film transistor both are connected to the inverting input end of the signal processing circuit, and the preset reference signal is correspondingly connected to the non-inverting input end of the signal processing circuit. A frequency-modulation control signal is directly connected to a gate electrode of the fifth thin film transistor and is connected to a gate electrode of the sixth thin film transistor through an inverter, and the switch signal comprises the frequency-modulation control signal.

For example, the preset reference signal is a common-mode voltage signal that is used to provide a DC voltage base level for a circuit operational amplifier.

For example, the initial signal is an output signal of a detection sensor; the preset reference signal is an output signal of a shielded sensor that is identical to the detection sensor, and the shielded sensor is a sensor in a non-detecting state and is configured to eliminate signal interference caused by non-detection signals in the detection sensor.

For example, the signal processing circuit comprises an operational amplifier, a first feedback capacitor, a second feedback capacitor, a first reset switch, and a second reset switch; one end of the first feedback capacitor is connected to a non-inverting input end of the operational amplifier, and other end of the first feedback capacitor is connected to a non-inverting output end of the operational amplifier; one end of the second feedback capacitor is connected to an inverting input end of the operational amplifier, and other end of the second feedback capacitor is connected to an inverting output end of the operational amplifier; the first reset switch is connected in parallel with the first feedback capacitor, and the second reset switch is connected in parallel with the second feedback capacitor.

For example, the first reset switch and the second reset switch are a same reset switch.

For example, the first reset switch and the second reset switch perform a reset operation after each hopping or switching of the frequency-modulation control signal.

An embodiment of the present disclosure further provides an anti-noise signal modulation method, which is applied to any one of the frequency-modulation control sub-circuits described above, comprising:

inputting a preset forward frequency-modulation control signal, allowing that the initial signal is input to the non-inverting input end of the signal processing circuit and the preset reference signal is input to the inverting input end of the signal processing circuit;

switching a potential of the preset forward frequency-modulation control signal to obtain a backward frequency-modulation control signal, allowing that the initial signal is input to the inverting input end of the signal processing circuit and the preset reference signal is input to the non-inverting input end of the signal processing circuit;

controlling the preset forward frequency-modulation control signal and the backward frequency-modulation control signal to be input according to a preset control period, allowing that a frequency of the initial signal is shifted to a frequency corresponding to the preset control period, wherein, the frequency corresponding to the preset control period is different from the noise frequency.

An embodiment of the present disclosure further provides a display panel, comprising a detection sensor, a detection circuit, and the frequency-modulation control sub-circuit according to any one of the above embodiments. The detection sensor is connected to an input end of the frequency-modulation control sub-circuit, and the detection circuit is connected to an output end of the frequency-modulation control sub-circuit.

For example, the frequency-modulation control sub-circuit is disposed at a position close to the detection sensor.

An embodiment of the present disclosure further provides a display device, comprising the display panel according to any one of the above embodiments.

BRIEF DESCRIPTION OF THE DRAWINGS

In order to clearly illustrate the technical solutions of the embodiments of the disclosure, the drawings required for describing the embodiments or related technologies will be briefly described in the following; it is obvious that the described drawings are only related to some embodiments of the present disclosure. Those of ordinary skill in the art can obtain other drawing(s), without any inventive work, according to these drawings.

DETAILED DESCRIPTION

In order to make objects, technical details and advantages of the present disclosure, the technical solutions of the embodiments will be described in a clearly and fully understandable way in conjunction with the specific embodiments and with reference to the accompanying drawings. Apparently, the described embodiments are just a part but not all of the embodiments of the disclosure. Based on the described embodiments herein, those skilled in the art can obtain other embodiment(s), without any inventive work, which should be within the scope of the disclosure.

It should be noted that, the terms "first," "second," etc., which are used in the present disclosure, are used to distinguish two non-identical entities or non-identical parameters that have the same name, it can be seen that the terms "first," "second," etc., are merely for convenience of description, and should not be construed as limiting the embodiments of the present disclosure, which will not be further described in the following embodiments.

Figure 1:
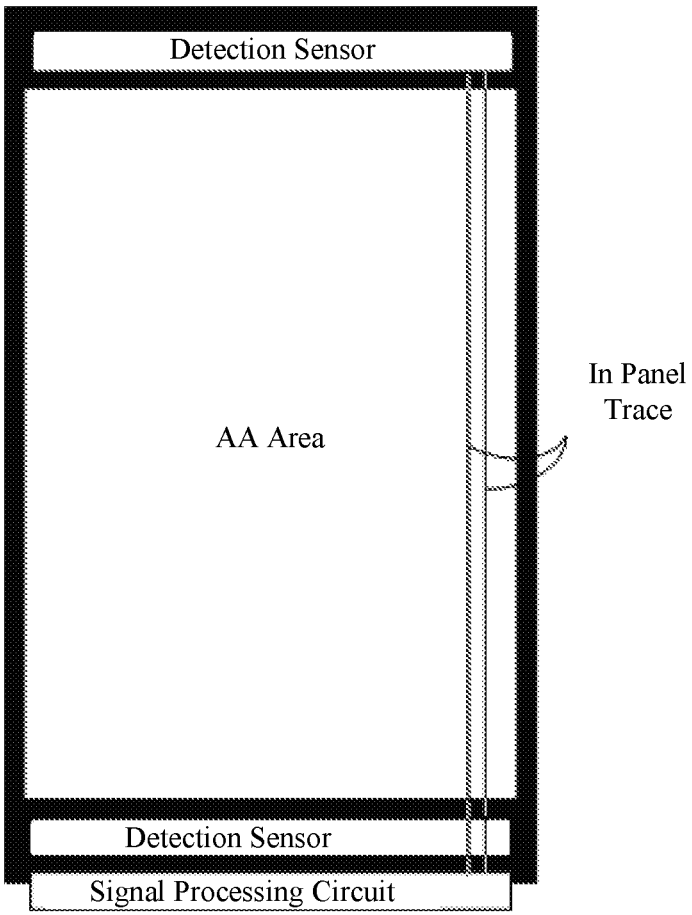
FIG. 1 is a schematic diagram of the connection between a detection sensor and a signal processing circuit on a display provided by an embodiment of the present disclosure.

In a current process in which related signals need to be processed, because an obtained initial signal needs to be transmitted over a certain distance, resulting in that the initial signal is interfered by a noise of a frequency during a transmission process, and current technology is difficult to effectively eliminate interference of the noise signal having a similar frequency. For example, in the case that both a detection sensor and a signal processing circuit are provided in a device (particularly in the case where the detection sensor needs to be connected to the signal processing circuit via a long wiring), due to the various signal transmission processes of the device, the detection signal in the wiring may be interfered by noise. Especially in a case where a noise frequency in the device is close to or the same as the frequency of the detection signal, an effect of the noise is more serious. Taking the signal detection in the display as an example, referring to FIG. 1, that is a schematic diagram of a connection between a detection sensor and a signal processing circuit on a display provided by an embodiment of the present disclosure. In FIG. 1, based on detection requirements, detection sensors (for example, the detection sensors are in-plane sensors) need to be provided on an above side and a below side of a display area (AA area), however a signal processing circuit (for example, the signal processing circuit is a detection circuit) is disposed on the below side of the display area. Therefore, the detection sensor on the above side of the display area needs to be connected to the signal processing circuit through a long wiring (for example, the long wiring is an in-panel wiring), and relevant signals will interfere with the detection signal in the wiring during an operation process of the display. Eventually, the detection result of the detection signal is inaccurate.

Figure 2:
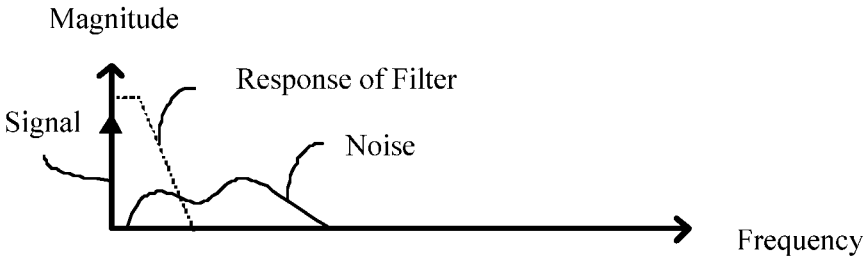
FIG. 2 is a schematic diagram of signal interference in a case that a detection signal and a noise signal have similar frequencies provided by an embodiment of the present disclosure.

An embodiment of the present disclosure provides an anti-noise signal modulation circuit, a modulation method, a display panel and a display device, which can improve an anti-noise ability of an initial signal, increase a signal-to-noise ratio, so interference of noise signals can be effectively eliminate in a subsequent filtering process, and accuracy of the initial signal can be improved. Referring to FIG. 2, which is a schematic diagram of signal interference in a case that a detection signal and a noise have similar frequencies provided by an embodiment of the present disclosure. A signal shown in FIG. 2 is the detection signal, and the response of a filter shown in FIG. 2 is the response in a filter frequency band. Because the frequency of the filter frequency band and the frequency of the noise overlap, resulting in that the noise signal in the detection signal is difficult to be eliminated. It can be seen from the FIG. 2, in a case that the frequency of the noise signal is close to the frequency of the detection signal, a frequency overlapping portion exists, and the existing technology is difficult to effectively filter out such frequency interference. Therefore, the embodiments of the present disclosure modulate the detection signal by using a frequency shift method, so that the frequency of the detection signal can be changed by modulating before the detection signal is interfered, thereby avoiding the noise band in the device, and improving the signal-to-noise ratio thereof.

Figure 3:
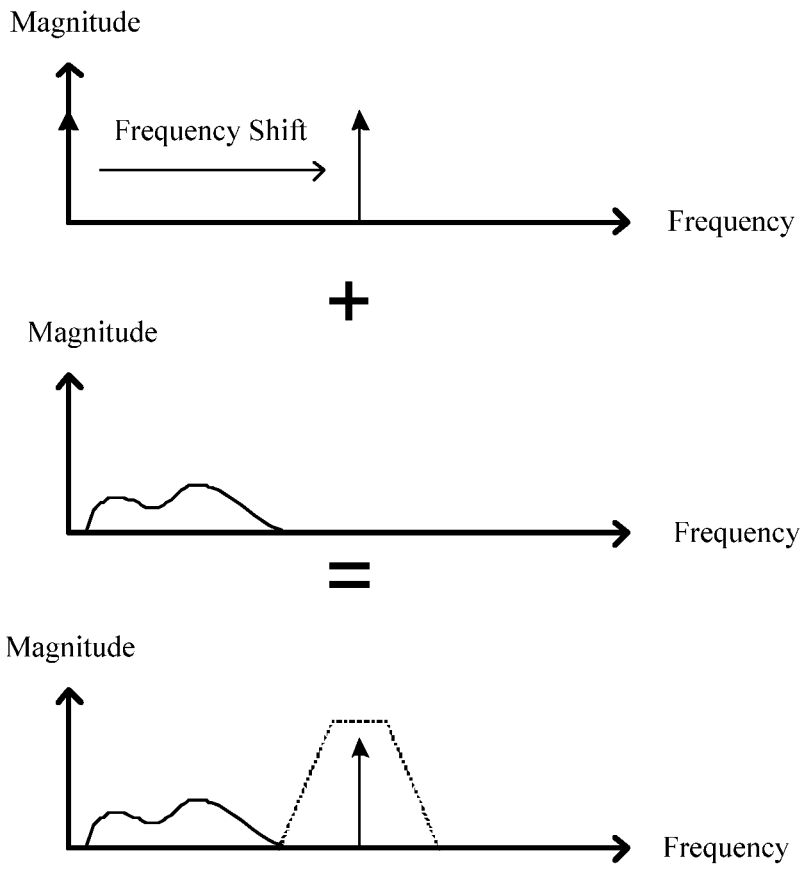
FIG. 3 is a schematic diagram of the principle of performing frequency shift processing on a detection signal provided by an embodiment of the present disclosure.

Referring to FIG. 3, which is a schematic diagram of the principle of performing frequency shift processing on a detection signal provided by an embodiment of the present disclosure. It can be seen from the FIG. 3, the frequency of the detection signal is changed by using the frequency shift method, and thus in a case that the detection signal and the noise signal are fused and interfered with each other, there is no frequency overlapping portion between the detection signal and the noise signal. In this case, even if an interference signal is still in the detection signal, based on the frequency difference between the detection signal and the noise signal, the noise signal can be quickly and effectively filtered out by the filtering technology.

Figure 4:
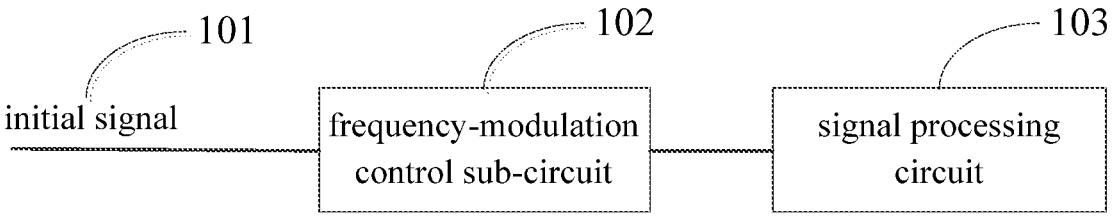
FIG. 4 is a schematic diagram of a first structure of an anti-noise signal modulation circuit provided by an embodiment of the present disclosure.

In some embodiments of the present disclosure, referring to FIG. 4, an anti-noise signal modulation circuit comprises a frequency-modulation control sub-circuit 102. An input end of the frequency-modulation control sub-circuit 102 is configured to receive an initial signal 101, and an output end of the frequency-modulation control sub-circuit 102 is connected to a signal processing circuit 103 that is preset; the frequency-modulation control sub-circuit 102 frequency-modulates the initial signal 101 by a switch signal that hops according to a preset period, and then outputs a modulation result to the signal processing circuit 103. The frequency corresponding to the switch signal avoids a noise frequency. For example, the initial signal 101 can be either a detection signal obtained by a detection sensor, or a detection signal or a non-detection signal obtained in other methods. Generally, the detection sensor disposed in a device is used for detecting related information of the device, and the initial signal output by the detection sensor needs to be transmitted to a corresponding signal processing circuit for signal processing. The signal processing circuit is configured to process the initial signal (e.g., the detection signal output by the detection sensor) and output the processed initial signal to a corresponding subsequent unit. The noise includes signal interference caused by the related operation of the device or the external related signal during a transmission process of the initial signal. In the embodiment of the present disclosure, the frequency-modulation control sub-circuit 102, which is controlled by the switch signal, is added between the initial signal 101 and the signal processing circuit 103 to implement a frequency shift operation of the initial signal, so the initial signal output from the detection sensor is at different frequency than the noise signal. Therefore, the frequency-modulation control sub-circuit is generally disposed on one side of the detection sensor, namely on the side of the initial signal, and then is connected to the signal processing circuit through a wiring.

It can be seen from the above embodiment that the anti-noise signal modulation circuit, by setting a frequency-modulation control sub-circuit that is capable of signal frequency-modulation between the initial signal and the signal process circuit, shifts the initial signal to a frequency different from the frequency of the noise by frequency-modulating, so the related noise signal can be quickly and accurately filtered out in the subsequent filtering process. In addition, based on the considerations of signal processing efficiency and timeliness, the embodiments of the present disclosure can achieve the modulation of the frequency of the detection signal by the switch signal that hops according to a preset period, and only the period of the switch signal needs to be controlled according to the frequency response of the device, that is, the frequency shift processing of the frequency of the initial signal can be implemented. In this way, not only the frequency-modulation control structure is very simple, but also the control of the frequency conversion is relatively rapid and reliable. The anti-noise signal modulation circuit can improve the anti-noise ability of the detection signal, increase the signal-to-noise ratio, and therefore the interference of the noise signal can be effectively eliminated in the subsequent filtering process, and the accuracy and reliability of the subsequent filtering and processing for the initial signal can be improved.

In some embodiments of the present disclosure, the frequency-modulation control sub-circuit includes a gating loop controlled by a preset periodic signal. The gating loop is configured to input the initial signal to a non-inverting input end of the signal processing circuit during a first time period of the preset periodic signal, and to input the initial signal to an inverting input end of the signal processing circuit during a second time period of the preset periodic signal. A preset reference signal is connected to the inverting input end of the signal processing circuit during the first time period, and is connected to the non-inverting input end of the signal processing circuit during the second time period. The preset reference signal is used as a reference basis for the initial signal in the signal processing circuit. For example, in a process of processing the initial signal, a reference signal usually needs to be set, so that a certain potential difference between the detection signal and the reference signal is formed and then is input to a corresponding signal processing circuit. However, the preset reference signal in the embodiment of the present disclosure is a reference signal set for the initial signal. The gating loop used in the embodiment is not only easily implemented, simple to be controlled, and has preferably timeliness and stability. In addition, the control of the target frequency is easily adjusted by the control of the gating loop. Therefore, in the embodiment, the gating loop is controlled by the preset periodic signal, and the frequency of the initial signal is shifted to a frequency corresponding to the preset periodic signal, thus the initial signal can avoid the noise frequency, and the anti-noise capability of the signal detection can be improved.

For example, one control period of the preset periodic signal can comprises the first time period and the second time period only, or may also comprise a plurality of time periods or a combination of different time periods as needed. In this way, the periodic signal can achieve more complex control requirements.

Figure 5:
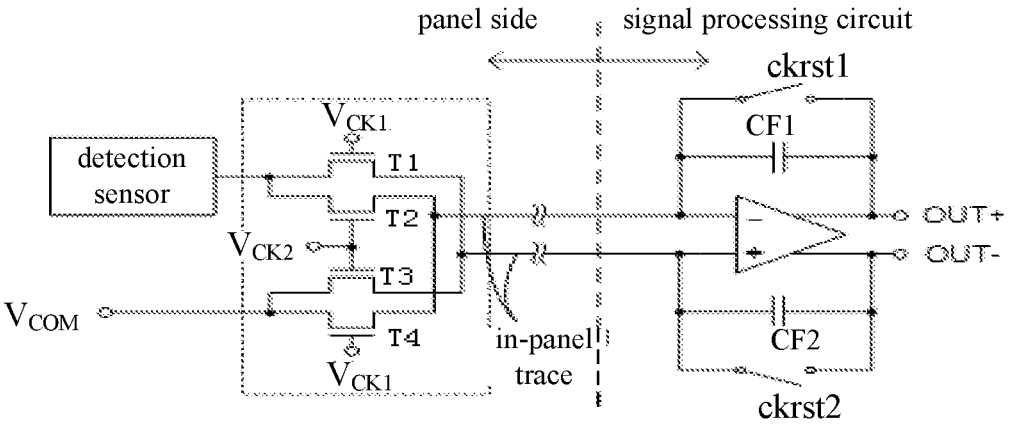
FIG. 5 is a schematic diagram of a second structure of an anti-noise signal modulation circuit provided by an embodiment of the present disclosure.

In some embodiments of the present disclosure, a specific frequency-modulation control sub-circuit is provided. Referring to FIG. 5, which is a schematic diagram of a specific circuit structure of an anti-noise signal modulation circuit provided by an embodiment of the present disclosure. The frequency-modulation control sub-circuit comprises a first thin film transistor T1, a second thin film transistor T2, a third thin film transistor T3, and a fourth thin film transistor T4. The detection sensor is connected to a first electrode of the first thin film transistor T1 and a first electrode of the second thin film transistor T2 respectively. The preset reference signal (e.g., Vcom) is connected to a first electrode of the third thin film transistor T3 and a first electrode of the fourth thin film transistor T4. A second electrode of the first thin film transistor T1 and a second electrode of the third thin film transistor T3 are both connected to the non-inverting input end (input end "+") of the signal processing circuit, and a second electrode of the second thin film transistor T2 and a second electrode of the fourth thin film transistor T4 are both connected to the inverting input end (input end "−") of the signal processing circuit. Alternatively, the second electrode of the first thin film transistor T1 and the second electrode of the third thin film transistor T3 are both connected to the inverting input end of the signal processing circuit, the second electrode of the second thin film transistor T2 and the second electrode of the fourth thin film transistor T4 are both connected to the non-inverting input end of the signal processing circuit. In this embodiment, the initial signal is the detection signal output by the detection sensor.

A gate electrode of the first thin film transistor and a gate electrode of the fourth thin film transistor both are connected to a first control signal (for example, $V_{CK1}$), a gate electrode of the second thin film transistor and a gate electrode of the third film transistor both are connected to a second control signal (for example, $V_{CK2}$), and the modulation pulse signal output by the first control signal and the modulation pulse signal output by the second control signal have opposite potentials.

For example, the first electrode is a source electrode or a drain electrode, and the second electrode is a drain electrode or a source electrode corresponding to the first electrode; in addition, the setting modes of the source/drain electrodes of the four thin film transistors do not interfere with each other. In order to further clarify the specific connection relationship, the first thin film transistor, the second thin film transistor, the third thin film transistor and the fourth thin film transistor are sequentially arranged from top to bottom in a virtual frame in the drawing. The preset reference signal is a common-mode voltage $V_{COM}$; the common-mode voltage is a bias value which is given according to the operation of the circuit, is generally half of a supply voltage, and is used for providing a DC voltage base level of the circuit operational amplifier (OPA). The first control signal corresponds to the $V_{CK1}$ in the drawing, and the second control signal corresponds to $V_{CK2}$ in the drawing. An in-panel trace is disposed between the frequency-modulation control sub-circuit and the signal processing circuit on the right side. In addition, based on FIG. 5, the related circuit of the display is taken as an example to describe, so the detection sensor and the frequency-modulation control sub-circuit are disposed on the panel side, on the left side of the dotted line, and the signal processing circuit is disposed on the right side of the dotted line.

When the first control signal ($V_{CK1}$) is at a high level, and the second control signal ($V_{CK2}$) is at a low level, the detection signal output by the detection sensor is connected to the non-inverting input end of the signal processing circuit, and the inverting input end of the signal processing circuit is connected to the preset reference signal ($V_{COM}$). When the first control signal ($V_{CK1}$) is at a low level, and the second control signal ($V_{CK2}$) is at a high level, the detection signal is connected to the inverting input end of the signal processing circuit, and the preset reference signal ($V_{COM}$) is connected to the non-inverting input end of the signal processing circuit. The clock period corresponding to a frequency-modulation control signal is T, and the detection signal can be frequency-shifted to a frequency band having a frequency of 1/T, to avoid the noise on the panel. In this way, by controlling output voltage signals of the first control signal and the second control signal, turning-on and -off of the thin film transistor can control the switching between the case that the detection sensor and the reference signal are respectively inputted to the non-inverting input end and the inverting input end of the signal processing circuit and the case that the detection sensor and the reference signal are respectively inputted to the inverting input end and the non-inverting input end of the signal processing circuit, so the frequency of the detection signal is shifted to the control frequency of the first control signal and the second control signal. Therefore, as long as that the control frequency averts from the noise frequency, the detection signal can be modulated to avoid the noise frequency, the anti-noise ability of the sensor signal can be improved, which is conductive to the following noise filtering.

In some embodiment of the present disclosure, the first control signal ($V_{CK1}$) and the second control signal ($V_{CK2}$) are timing signals having opposite potentials and a period of T; the signal frequency 1/T corresponding to the timing signals is different from the noise frequency. For example, in the embodiment, the switch signal in the operation of "frequency-modulating the initial signal by a switch signal that hops according to a preset period" comprises the first control signal ($V_{CK1}$) and the second control signal ($V_{CK2}$), that is, comprises the timing signals having opposite potentials and a period of T.

Figure 6:
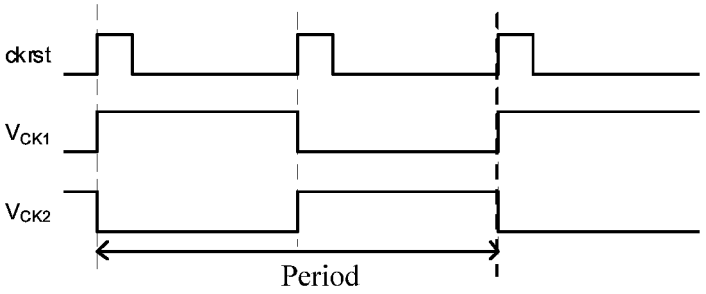
FIG. 6 is a schematic diagram of an embodiment of a corresponding control signal and a corresponding reset signal in FIG. 5.

Referring to FIG. 6, which is schematic diagram of an embodiment of a corresponding control signal and a corresponding reset signal (ckrst) in FIG. 5 provided by an embodiment of the present disclosure. Only the hopping period T of the first control signal and the second control signal needs to be correspondingly adjusted, the setting of target frequency-shifting frequency can be quickly achieved. Especially, when the noise frequency of the device needs to be avoided through testing, the adjustment of the modulation target frequency can be quickly and stably implemented by the control of the switch signal.

In some embodiments of the present disclosure, the frequency-modulation control sub-circuit adopts at least two groups of thin film transistors to form a mirror structure, and is configured to control the high level and low level in the control signal, so the initial signal forms current flows in different directions based on the mirror structure and then is input as the current flows to the signal processing circuit. The frequency-modulation control sub-circuit achieves to modulate the frequency of the initial signal by the current flows in different directions. In a COMS device, when the detection sensor outputs a current detection signal, the embodiment of the present disclosure provides a mirror symmetrical TFT switch such that the output detection signals have different current flows, and the modulation of the signal frequency is achieved.

Figure 8:
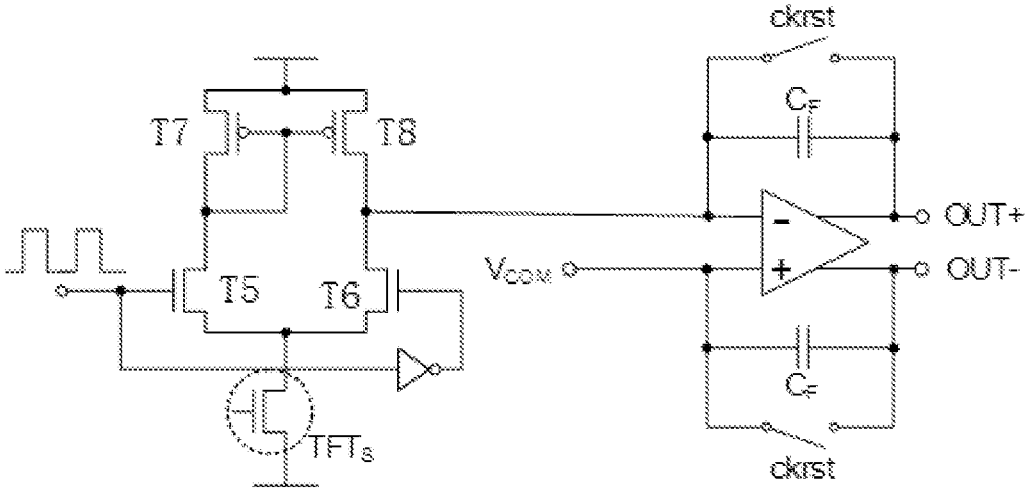
FIG. 8 is a schematic diagram of a fourth structure of an anti-noise signal modulation circuit provided by an embodiment of the present disclosure.

In some embodiments of the present disclosure, a specific frequency-modulation control sub-circuit is provided. Referring to FIG. 8, which is a schematic diagram of another specific circuit structure of an anti-noise signal modulation circuit provided by an embodiment of the present disclosure. The frequency-modulation control sub-circuit comprises a fifth thin film transistor T5, a sixth thin film transistor T6, a seventh thin film transistor T7, and an eighth thin film transistor T8. A first electrode of the fifth thin film transistor T5 and a first electrode of the sixth thin film transistor T6 both are connected to an output end of the detection sensor (the detection sensor is labeled as TFTs in FIG. 8), that is, connected to the initial signal. A second electrode of the fifth thin film transistor T5 is connected to a first electrode of the seventh thin film transistor T7, a gate electrode of the seventh thin film transistor T7, and a gate electrode of the eighth thin film transistor T8. A second electrode of the seventh thin film transistor T7 is connected to a second electrode of the eighth thin film transistor T8. A first electrode of the eighth thin film transistor T8 and a second electrode of the sixth thin film transistor T6 both are connected to the non-inverting input end of the signal processing circuit, and the preset reference signal is correspondingly connected to the inverting input end of the signal processing circuit; alternatively, as shown in FIG. 8, the first electrode of the eighth thin film transistor T8 and the second electrode of the sixth thin film transistor T6 both are connected to the inverting input end of the signal processing circuit, and the preset reference signal is correspondingly connected to the non-inverting input end of the signal processing circuit. The frequency-modulation control signal (the pulse signal shown in FIG. 8) is directly connected to a gate electrode of the fifth thin film transistor T5, and the frequency-modulation control signal is connected to a gate electrode of the sixth thin film transistor T6 through an inverter. For example, the first electrode is a source electrode or a drain electrode, and the second electrode is a drain electrode or a source electrode corresponding to the first electrode. The seventh thin film transistor T7 and the eighth thin film transistor T8 are arranged on the upper side of the FIG. 8 from left to right respectively, and the fifth thin film transistor T5 and the sixth thin film transistor T6 are arranged on the lower side of the FIG. 8 from left to right respectively. The frequency-modulation control signal is correspondently input to an input end on the left side of the FIG. 8. When the frequency-modulation control signal is at a high level, the fifth thin film transistor T5 is turned on and the sixth thin film transistor T6 is turned off, in this way, the initial signal output from the detection sensor is input to a mirror structure formed by the seventh thin film transistor T7 and the eighth thin film transistor T8 through the fifth thin film transistor T5 that is turned on, and then is input to a signal detection circuit through the first electrode of the eighth thin film transistor T8. Conversely, when the frequency-modulation control signal is at a low level, the fifth thin film transistor T5 is turned off and the sixth thin film transistor T6 is turned on, so the detection signal is input into the signal processing circuit through the sixth thin film transistor T6 that is turned on. In this way, by controlling the detection signal output from the detection sensor to form a reverse current flow, the frequency of the detection signal is modulated to the frequency corresponding to the frequency-modulation control signal. That is, a stable and reliable frequency modulation operation of the detection signal is achieved. For example, in the embodiment, the switch signal in the operation of "frequency-modulating the initial signal by a switch signal that hops according to a preset period" comprises the frequency-modulation control signal.

For example, in the embodiment corresponding to the FIG. 8, the detection signal is input to the inverting input end of the signal processing circuit, and the preset reference signal is input to the non-inverting input end of the signal processing circuit. However, according to actual needs, it is also possible that the detection signal is input to the non-inverting input end of the signal processing circuit and the preset reference signal is input to the inverting input end of the signal processing circuit.

Figure 7:
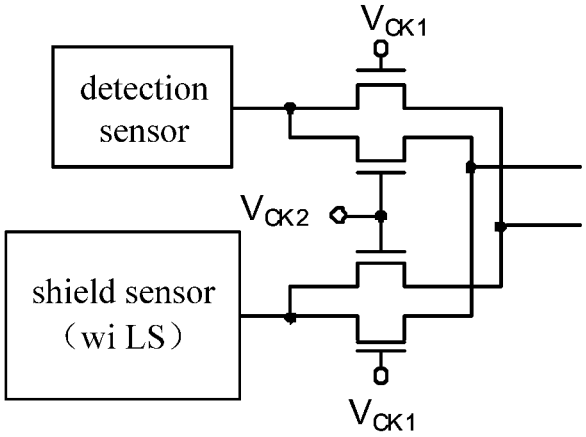
FIG. 7 is a schematic diagram of a third structure of an anti-noise signal modulation circuit provided by an embodiment of the present disclosure.

Referring to FIG. 7, which is a schematic diagram of still another specific circuit structure of an anti-noise signal modulation circuit provided by an embodiment of the present disclosure. The initial signal is an output signal of the detection sensor; and the preset reference signal is an output signal of a shielded sensor (wi LS) that is identical to the detection sensor. The shielded sensor is such a sensor in a non-detecting state, and is used for eliminating signal interference caused by non-detection signals in the detection sensor. A light sensor is used to perform the detection, which is taken as an example, because the light sensor itself likely has interference factors such as a dark current, the effects such as the inherent dark current and the voltage drift in the light sensor can be eliminated, by using identical light sensors and then shading the light sensors. Certainly, based on detection principles of different detection sensors, the preset reference signal can be correspondingly designed to be completely the same as a corresponding output signal of the detection sensor in the non-detection state, thus the interference caused by the detection sensor itself can be eliminated.

In some embodiments of the present disclosure, referring to FIG. 5, the signal processing circuit comprises an operational amplifier, a first feedback capacitor CF1, a second feedback capacitor CF2, a first reset switch ckrst1, and a second reset switch ckrst2. One end of the first feedback capacitor CF1 is connected to a non-inverting input end of the operational amplifier, the other end of the first feedback capacitor CF1 is connected to a non-inverting output end of the operational amplifier. One end of the second feedback capacitor CF2 is connected to an inverting input end of the operational amplifier, the other end of the second feedback capacitor CF2 is connected to an inverting output end of the operational amplifier. The first reset switch ckrst1 is connected in parallel with the first feedback capacitor CF1, and the second reset switch ckrst2 is connected in parallel with the second feedback capacitor CF2. For example, a reset switch is used to reset the initial signal input to the signal processing circuit at the beginning of each period. For example, the first reset switch and the second reset switch are combined to same one reset switch. In this way, the remaining charge in the two feedback capacitors can be released at the same time, that is, the reset of the detection signal input in each period can be achieved by the reset switches, so that the signal in a previous period does not affect the signal in a next period.

For example, referring to FIG. 6, the first reset switch and the second reset switch are controlled by a reset signal ckrst, and perform a reset operation after the frequency-modulation control signal hops or is switched every time. That is, in a frequency modulation control period, so long as the frequency-modulation control voltage hops, the reset operation is performed once, so as to prevent the detection signal that is before hopping from affecting the detection signal that is after hopping. In this way, the accuracy and the stability of the detection signal input to the signal processing circuit can be further improved.

In some embodiments of the present disclosure, an anti-noise signal modulation method is provided. Firstly the frequency-modulation control sub-circuit described in any one of the above embodiments needs to be provided between the initial signal and the signal processing circuit. The anti-noise signal modulation method comprises the following operations:

inputting a preset forward frequency-modulation control signal, allowing that the initial signal is input to the non-inverting input end of the signal processing circuit and the preset reference signal is input to the inverting input end of the signal processing circuit;

switching a potential of the preset forward frequency-modulation control signal to obtain a backward frequency-modulation control signal, allowing that the initial signal is input to the inverting input end of the signal processing circuit and the preset reference signal is input to the non-inverting input end of the signal processing circuit; and controlling the preset forward frequency-modulation control signal and the backward frequency-modulation control signal to be input according to a preset control period, allowing that a frequency of the initial signal is shifted to a frequency corresponding to the preset control period, and the frequency corresponding to the preset control period is different from the noise frequency.

In this way, by controlling the frequency-modulation control signal, the frequency of the obtained initial signal can be modulated to the frequency corresponding to the frequency-modulation control signal, and the frequency of the initial signal avoids the noise frequency, and the noise frequency can be quickly and effectively filtered in the subsequent filtering.

In some embodiments, the present disclosure further provides a display panel. The display panel is provided with a detection sensor, a signal processing circuit (for example, a detection circuit), and the frequency-modulation control sub-circuit according to any one of the above embodiments. The detection sensor is connected to an input end of the frequency-modulation control sub-circuit, and the signal processing circuit is connected to an output end of the frequency-modulation control sub-circuit. For example, the detection sensor is configured to obtain relevant information in the display panel through signal detection, thereby obtaining an initial signal; the signal processing circuit is configured to perform related signal processing on the initial signal output by the detection sensor. In this way, the initial signal obtained through detection in the display panel can avoid the noise frequency, and the accuracy of the signal can be ensured.

For example, the frequency-modulation control sub-circuit is disposed at a position close to the detection sensor. In this way, the noise signal will not be frequency modulated, and the accuracy and reliability of the frequency-shift processing for the initial signal are improved.

In some embodiments of the present disclosure, a display device is also provided. The display device comprises the anti-noise signal modulation circuit/the display panel described in any one of the above embodiments of the present disclosure.

Those of ordinary skill in the art should understand that: discussions of any of the above embodiments are only exemplary, and are not intended to suggest that the scope of the present disclosure (including the claims) is limited to these examples; in accordance with the idea of the present disclosure, the above embodiments or the technical features in different embodiments may also be combined, the steps may be performed in any orders, and there are many other variations of the various aspects of the present disclosure as described above, and the many other variations have not been provided in the details for the sake of brevity.

In addition, in order to simplify the description and discussion, and in order not to make the present disclosure difficult to understand, the accompanying drawings provided can show or not show well-known power/ground connections to integrated circuit chips and other components. Furthermore, the apparatus may be shown in block diagram form in order to avoid making the present disclosure difficult to understand, and this also takes into account following facts that the details of the implementations of these devices in the block diagram are highly dependent on the platform on which the present disclosure is to be implemented (i.e., these details should be completely within the understanding of those skilled in the art). In a case that specific details are set forth to describe the exemplary embodiments of the present disclosure, it is apparent to those skilled in the art that the present disclosure may be implemented without these specific details or with variations in the specific details. Therefore, these descriptions should be considered as illustrative and not restrictive.

Although the present disclosure has been described in connection with the specific embodiments of the present disclosure, many alternatives, modifications and variations to these embodiments will be apparent to those skilled in the art. For example, other memory architectures (e.g., dynamic RAM (DRAM)) can use the embodiments discussed.

The embodiments of the present disclosure are intended to cover all such alternatives, modifications and variations that are included within the board scope of the appended claims. Therefore, any omissions, modifications, equivalents, improvements, etc., made within the spirit and scope of the present disclosure, are intended to be included within the scope of the present disclosure.

The present application claims priority to Chinese patent application No. 201710556766.1, filed on Jul. 10, 2017, the entire disclosure of which is incorporated herein by reference as part of the present application.

What is claimed is:

1. An anti-noise signal modulation circuit, comprising:

a frequency-modulation control sub-circuit, wherein an input end of the frequency-modulation control sub-circuit is configured to receive an initial signal, and an output end of the frequency-modulation control sub-circuit is connected to a signal processing circuit that is preset;

the frequency-modulation control sub-circuit is configured to frequency-modulate the initial signal by a switch signal that hops according to a preset period, and to output a modulation result to the signal processing circuit;

a frequency corresponding to the switch signal does not overlap with a noise frequency;

the frequency-modulation control sub-circuit comprises a gating loop controlled by a preset periodic signal, the gating loop is configured to: input the initial signal to a non-inverting input end of the signal processing circuit during a first time period of the preset periodic signal, and to input the initial signal to an inverting input end of the signal processing circuit during a second time period of the preset periodic signal;

a preset reference signal is connected to the inverting input end of the signal processing circuit during the first time period, and is connected to the non-inverting input end of the signal processing circuit during the second time period; and the preset reference signal is used as a reference basis for the initial signal in the signal processing circuit;

the frequency-modulation control sub-circuit comprises a first thin film transistor, a second thin film transistor, a third thin film transistor, and a fourth thin film transistor;

the initial signal is connected to a first electrode of the first thin film transistor and a first electrode of the second thin film transistor, and the preset reference signal is connected to a first electrode of the third thin film transistor and a first electrode of the fourth thin film transistor;

a connection between thin film transistors and the signal processing circuit is realized in at least two connection modes, a first connection mode of which is that: a second electrode of the first thin film transistor and a second electrode of the third thin film transistor are both connected to the non-inverting input end of the signal processing circuit, and a second electrode of the second thin film transistor and a second electrode of the fourth thin film transistor are both connected to the inverting input end of the signal processing circuit; a second connection mode of which is that: the second electrode of the first thin film transistor and the second electrode of the third thin film transistor are both connected to the inverting input end of the signal processing circuit, and the second electrode of the second thin film transistor and the second electrode of the fourth thin film transistor are both connected to the non-inverting input end of the signal processing circuit;

a gate electrode of the first thin film transistor and a gate electrode of the fourth thin film transistor both are connected to a first control signal, a gate electrode of the second thin film transistor and a gate electrode of the third film transistor both are connected to a second control signal, the first control signal and the second control signal are modulation pulse signals having opposite potentials, and the switch signal comprises the first control signal and the second control signal.

2. The anti-noise signal modulation circuit according to claim 1, wherein the first control signal and the second control signal are timing signals having opposite potentials and a period of T, and a signal frequency 1/T corresponding to the timing signals is different from the noise frequency.

3. An anti-noise signal modulation circuit, comprising:

a frequency-modulation control sub-circuit, wherein an input end of the frequency-modulation control sub-circuit is configured to receive an initial signal, and an output end of the frequency-modulation control sub-circuit is connected to a signal processing circuit that is preset;

the frequency-modulation control sub-circuit is configured to frequency-modulate the initial signal by a switch signal that hops according to a preset period, and to output a modulation result to the signal processing circuit;

a frequency corresponding to the switch signal does not overlap with a noise frequency;

the frequency-modulation control sub-circuit adopts at least two groups of thin film transistors to form a mirror structure, and is configured to control both a high level and a low level in a control signal, and the initial signal forms current flows in different directions based on the mirror structure and is input to the signal processing circuit; the frequency-modulation control sub-circuit achieves to modulate a frequency of the initial signal by the current flows in different directions.

4. The anti-noise signal modulation circuit according to claim 3, wherein the frequency-modulation control sub-circuit comprises a fifth thin film transistor, a sixth thin film transistor, a seventh thin film transistor, and an eighth thin film transistor;

a first electrode of the fifth thin film transistor and a first electrode of the sixth thin film transistor both are connected to the initial signal; a second electrode of the fifth thin film transistor is connected to a first electrode of the seventh thin film transistor, a gate electrode of the seventh thin film transistor, and a gate electrode of the eighth thin film transistor; and a second electrode of the seventh thin film transistor is connected to a second electrode of the eighth thin film transistor;

a first electrode of the eighth thin film transistor and a second electrode of the sixth thin film transistor both are connected to the non-inverting input end of the signal processing circuit, and the preset reference signal is correspondingly connected to the inverting input end of the signal processing circuit; alternatively, the first electrode of the eighth thin film transistor and the second electrode of the sixth thin film transistor both are connected to the inverting input end of the signal processing circuit, and the preset reference signal is correspondingly connected to the non-inverting input end of the signal processing circuit; and a frequency-modulation control signal is directly connected to a gate electrode of the fifth thin film transistor and is connected to a gate electrode of the sixth thin film transistor through an inverter, and the switch signal comprises the frequency-modulation control signal.

5. The anti-noise signal modulation circuit according to claim 1, wherein the preset reference signal is a common-mode voltage signal that is used to provide a DC voltage base level for a circuit operational amplifier.

6. The anti-noise signal modulation circuit according to claim 1, wherein the initial signal is an output signal of a detection sensor; the preset reference signal is an output signal of a shielded sensor that is identical to the detection sensor, and the shielded sensor is a sensor in a non-detecting state and is configured to eliminate signal interference caused by non-detection signals in the detection sensor.

7. A display panel, comprising:

a detection sensor, a signal processing circuit, and the anti-noise signal modulation circuit according to claim 1, wherein the detection sensor is connected to an input end of the frequency-modulation control sub-circuit.

8. A display device, comprising the display panel according to claim 7.

9. The display panel according to claim 7, wherein the signal processing circuit comprises an operational amplifier, a first feedback capacitor, a second feedback capacitor, a first reset switch, and a second reset switch;

one end of the first feedback capacitor is connected to a non-inverting input end of the operational amplifier, and other end of the first feedback capacitor is connected to a non-inverting output end of the operational amplifier;

one end of the second feedback capacitor is connected to an inverting input end of the operational amplifier, and other end of the second feedback capacitor is connected to an inverting output end of the operational amplifier; and the first reset switch is connected in parallel with the first feedback capacitor, and the second reset switch is connected in parallel with the second feedback capacitor.

10. The display panel according to claim 9, wherein the first reset switch and the second reset switch are a same reset switch.

11. The display panel according to claim 9, wherein the first reset switch and the second reset switch perform a reset operation after each hopping or switching of the frequency-modulation control signal.

12. An anti-noise signal modulation method, applied to an anti-noise signal modulation circuit, the anti-noise signal modulation circuit comprising:

a frequency-modulation control sub-circuit, wherein an input end of the frequency-modulation control sub-circuit is configured to receive an initial signal, and an output end of the frequency-modulation control sub-circuit is connected to a signal processing circuit that is preset;

the frequency-modulation control sub-circuit is configured to frequency-modulate the initial signal by a switch signal that hops according to a preset period, and to output a modulation result to the signal processing circuit; and a frequency corresponding to the switch signal does not overlap with a noise frequency, and a frequency of the modulation result not overlap with the noise frequency, the anti-noise signal modulation method comprising:

inputting a preset forward frequency-modulation control signal, allowing that the initial signal is input to the non-inverting input end of the signal processing circuit and the preset reference signal is input to the inverting input end of the signal processing circuit;

switching a potential of the preset forward frequency-modulation control signal to obtain a backward frequency-modulation control signal, allowing that the initial signal is input to the inverting input end of the signal processing circuit and the preset reference signal is input to the non-inverting input end of the signal processing circuit; and controlling the preset forward frequency-modulation control signal and the backward frequency-modulation control signal to be input according to a preset control period, allowing that a frequency of the initial signal is shifted to a frequency corresponding to the preset control period, wherein the frequency corresponding to the preset control period is different from the noise frequency.

* * * * *